US011347174B2

(12) United States Patent
Hanamoto et al.

(10) Patent No.: US 11,347,174 B2
(45) Date of Patent: May 31, 2022

(54) SHEET DISCHARGE DEVICE, AND DOCUMENT CONVEYING DEVICE AND IMAGE FORMING APPARATUS PROVIDED THEREWITH

(71) Applicant: KYOCERA Document Solutions Inc., Osaka (JP)

(72) Inventors: Katsuhiko Hanamoto, Osaka (JP); Hoang Danh Nguyen, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/235,742

(22) Filed: Apr. 20, 2021

(65) Prior Publication Data

US 2021/0333737 A1 Oct. 28, 2021

(30) Foreign Application Priority Data

Apr. 22, 2020 (JP) ..... JP2020-076364

(51) Int. Cl.
*B65H 31/20* (2006.01)
*G03G 15/00* (2006.01)
(Continued)

(52) U.S. Cl.
CPC ..... *G03G 15/6529* (2013.01); *B65H 9/06* (2013.01); *B65H 9/10* (2013.01); *B65H 9/101* (2013.01);
(Continued)

(58) Field of Classification Search
CPC ..... B65H 31/20; B65H 31/36; B65H 31/30; B65H 31/3036; B65H 9/06; B65H 9/10; B65H 9/101; G03G 15/6552
See application file for complete search history.

(56) References Cited

U.S. PATENT DOCUMENTS 6,568,669 B2 * 5/2003 Hosaka ..... B27F 7/17 227/100
7,547,015 B2 * 6/2009 Lee ..... B65H 31/20 271/224
(Continued)

FOREIGN PATENT DOCUMENTS

JP 2009-137719 A 6/2009
JP 2012-184106 A 9/2012

*Primary Examiner* — Leslie A Nicholson, III
(74) *Attorney, Agent, or Firm* — Stein IP, LLC

(57) ABSTRACT

A sheet discharge device includes: a sheet discharge portion; a sheet stacking portion having a sheet stacking surface for stacking a sheet discharged from the sheet discharge portion; and a stopper in the sheet stacking portion against which, for alignment, the leading end of the sheet discharged from the sheet discharge portion is thrust. The stopper has a support portion, a restricting portion, and an urging mechanism. The restricting portion is supported pivotally on a pivot shaft on the support portion, and is arranged either in a retracted position to lie flat substantially horizontally along the sheet stacking surface or in a restricting position to stand upright substantially vertically to the sheet stacking surface. The urging mechanism urges the restricting portion, when in retracted position, in a direction from restricting position to retracted position and, when in restricting position, in a direction from retracted position to restricting position.

8 Claims, 7 Drawing Sheets

(51) Int. Cl.

| | |
|---|---|
| ***B65H 31/26*** | (2006.01) |
| ***B65H 9/06*** | (2006.01) |
| ***B65H 31/36*** | (2006.01) |
| ***B65H 9/10*** | (2006.01) |
| *B65H 31/30* | (2006.01) |

(52) U.S. Cl.
CPC ..... *B65H 31/26* (2013.01); *B65H 31/36* (2013.01); *B65H 31/3036* (2013.01); *G03G 15/6552* (2013.01)

(56) References Cited

U.S. PATENT DOCUMENTS

| | | | | |
|---|---|---|---|---|
| 8,424,871 | B2 * | 4/2013 | Ino | B65H 31/26 271/223 |
| 8,430,399 | B1 * | 4/2013 | Huang | B65H 1/04 271/223 |
| 8,820,742 | B2 * | 9/2014 | Koyanagi | B65H 31/24 271/224 |
| 9,242,827 | B2 * | 1/2016 | Niimura | B65H 31/02 |
| 9,284,137 | B2 * | 3/2016 | Sato | B65H 1/04 |
| 9,630,788 | B2 * | 4/2017 | Horita | B65H 1/00 |
| 10,040,661 | B2 * | 8/2018 | Yoshida | B65H 31/26 |
| 11,130,649 | B2 * | 9/2021 | Okada | B65H 31/02 |
| 2012/0230748 | A1 | 9/2012 | Okano | 400/605 |
| 2021/0094781 | A1 * | 4/2021 | Yoshida | B65H 31/20 |
| 2021/0107301 | A1 * | 4/2021 | Takimoto | B41J 11/0045 |

* cited by examiner

SHEET DISCHARGE DEVICE, AND DOCUMENT CONVEYING DEVICE AND IMAGE FORMING APPARATUS PROVIDED THEREWITH

INCORPORATION BY REFERENCE

This application is based on and claims the benefit of Japanese Patent Application No. 2020-76364 filed on Apr. 22, 2020, the contents of which are hereby incorporated by reference.

BACKGROUND

The present disclosure relates to sheet discharge devices for discharging sheets, for incorporation in image forming apparatuses such as copiers and printers, sheet post-processing devices that perform predetermined post-processing on sheets having undergone image processing, and document conveying devices that automatically conveys sheet-form documents. The present disclosure also relates to document conveying devices and image forming apparatuses that incorporate such sheet discharge devices.

An image forming apparatus such as a copier, a laser printer, or the like has a discharge tray for discharging a sheet having a desired image formed on it through an electrophotographic process or a document having undergone document image reading by being conveyed to a document reading portion by a document conveying device. Generally, to secure a predetermined stack volume, the discharge tray has, formed between a discharge port and a stacking portion, an inclined surface with an upward slope toward the direction of discharge. Sheets or documents that have been discharged through the discharge port slide down across the inclined surface to be stacked with their trailing ends aligned.

Today, as increasingly fast image formation is desired, image forming apparatuses with fast conveyance speeds are in the mainstream. Sheets to be discharged can be conveyed at so high a speed that they may go beyond a curved portion between the inclined surface and the sheet stacking portion into the sheet stacking portion. This may prevent sheets from sliding down across the inclined surface, resulting in irregular stacking.

To cope with that, there have been proposed various methods of aligning discharged sheets neatly. For example, a known image forming apparatus includes a discharge portion into which sheets having undergone image formation are discharged, a discharge tray on which a placement portion is defined on which to place the sheets discharged from the discharge portion, a stopper provided in a part of the discharge tray farther forward in the discharge direction than the discharge portion so as to stop the sheets discharged from the discharge portion, and a plurality of depressed portions, recessed downward, provided in a part of the discharge tray closer than the stopper to the discharge portion. From the image forming apparatus, a user can thus easily pick out sheets of differing sizes.

For another example, a known sheet discharge device includes a discharge tray provided pivotally in an upper part of the main unit of the device and a sheet stopper held pivotally on the discharge tray, wherein a hook (elastic member) provided on the sheet stopper and a projection formed on the discharge tray constitute a restricting means for restricting the pivoting of the sheet stopper so that the pivoting of the sheet stopper is restricted with the friction resistance that results from elastic contact between the hook and the projection.

SUMMARY

According to one aspect of the present disclosure, a sheet discharge device includes: a sheet discharge portion, a sheet stacking portion, and a stopper. The sheet discharge portion discharges a sheet. The sheet stacking portion is disposed downstream of the sheet discharge portion with respect to the sheet discharge direction, and has a sheet stacking surface on which the sheet discharged from the sheet discharge portion is stacked. The stopper is provided in the sheet stacking portion, and the leading end of the sheet discharged from the sheet discharge portion is thrust against the stopper to be aligned. The stopper has a support portion, a restricting portion, and an urging mechanism. The restricting portion is supported pivotally on a pivot shaft provided on the support portion, and is arranged selectively in one of a retracted position in which the restricting portion lies flat substantially horizontally along the sheet stacking surface and a restricting position in which the restricting portion stands upright substantially vertically with respect to the sheet stacking surface. The urging mechanism applies a pivoting load to the restricting portion. The urging mechanism urges the restricting portion, when it is arranged in the retracted position, in a direction from the restricting position to the retracted position and urges the restricting portion, when it is arranged in the restricting position, in a direction from the retracted position to the restricting position.

This and other objects of the present disclosure, and the specific benefits obtained according to the present disclosure, will become apparent from the description of embodiments which follows.

DETAILED DESCRIPTION

Figure 1:
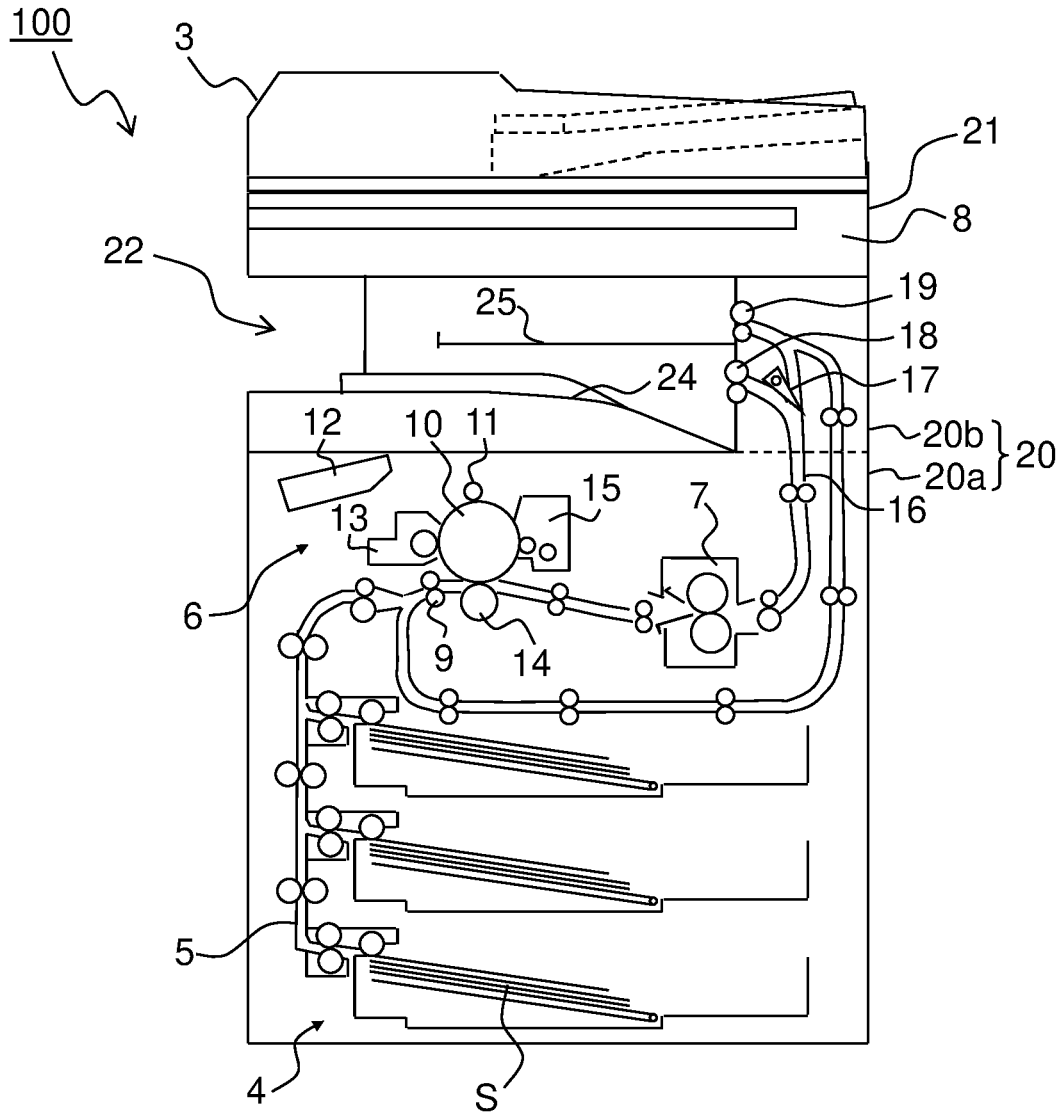
FIG. 1 is a diagram schematically showing an internal construction of an image forming apparatus provided with a document conveying device incorporating a sheet discharge device according to the present disclosure.

An embodiment of the present disclosure will be described below with reference to the accompanying drawings. FIG. 1 is a diagram schematically showing an internal construction of an image forming apparatus 100 provided with a document conveying device 3 incorporating a sheet discharge device according to the present disclosure. As shown in FIG. 1 the image forming apparatus 100 is what is called an in-body discharge digital multifunction peripheral, and is composed roughly of a main unit housing 20 and an upper housing 21 disposed on top of it.

The main unit housing 20 is composed of a lower housing 20*a* and a coupling housing 20*b* disposed above it and along the right side in FIG. 1 and coupled to the upper housing 21. Inside the lower housing 20*a*, there are provided a sheet feed portion 4 disposed in a lower part, a sheet conveying portion 5 disposed from at the side to over the sheet feed portion 4, an image forming portion 6 disposed over the sheet feed portion 4, and a fixing portion 7 disposed downstream of (in FIG. 1, on the right side of) the image forming portion 6 with respect to the sheet conveying direction. In the coupling housing 20*b*, there is provided a sheet discharge portion for conveying and discharging a sheet S having undergone fixing out of the main unit housing 20. Directly under the upper housing 21, at the left side of the coupling housing 20*b*, an in-body discharge space 22 is formed which is wide open to the left and to the front.

The image forming portion 6 forms a predetermined toner image on the sheet S through an electrophotographic process. The image forming portion 6 includes a photosensitive drum 10, which is a rotatably pivoted image carrying member, and further includes, disposed around the photosensitive drum 10 along its rotation direction, a charging device 11, an exposing device 12, a developing device 13, a transferring device 14, a cleaning device 15, and a destaticizing device (not shown).

Inside the upper housing 21, an image reading portion 8 is provided. The image reading portion 8 is for reading image information from a document D (one example of a sheet). When documents are read one by one, the document conveying device 3 is opened, and each document is placed on a contact glass which is provided on the top surface of the upper housing 21. When a bundle of documents is read automatically, with the document conveying device 3 closed, the bundle of documents is placed on a sheet feed tray of the document conveying device 3, so that, out of the bundle, documents are automatically fed one by one onto the contact glass.

Now, the basic operation of the image forming system 100 constructed as described above will be described. First, the surface of the photosensitive drum 10, which rotates counter-clockwise in FIG. 1, is electrostatically charged uniformly by the charging device 11. Then based on the image information read by the image reading portion 8, a beam of light is shone from the exposure device 12 to the circumferential surface of the photosensitive drum 10, so that an electrostatic latent image is formed on the surface of the photosensitive drum 10. To the electrostatic latent image, toner as developer is fed from the developing device 13, and thereby a toner image is formed.

Concurrently as the toner image is formed, a sheet S is fed from the sheet feed portion 4 into the sheet conveying passage 5, and is stopped momentarily at a pair of registration rollers 9. The sheet S stopped at the pair of registration rollers 9 is then, with predetermined timing, conveyed toward the photosensitive drum 10 having the toner image formed on it. There, by the transfer device 14, which includes a transfer roller and the like, the toner image on the surface of the photosensitive drum 10 is transferred to the sheet S. The sheet S having the toner image transferred to it is separated from the photosensitive drum 10, and is conveyed toward the fixing portion 7. As the sheet S passes through the fixing portion 7, it is heated and pressed, so that the toner image is fixed.

When the transfer of the toner image to the sheet S is complete, the photosensitive drum 10 is cleaned by the cleaning device 15 to remove residual toner left on the circumferential surface, and is then destaticized by the destaticizing device (not shown) to eliminate residual electric charge. Thereafter, the circumferential surface of the photosensitive drum 10 is once again electrostatically charged by the charging device 11, and image formation continues through a similar procedure.

The sheet S having passed through the fixing portion 7 is, as it is, conveyed along a vertical conveying passage 16, which extends vertically upward, into the coupling housing 20*b*. Inside the coupling housing 20*b*, an upper part of the vertical conveying passage 16 branches into two, an upper and a lower, conveying passages extending leftward. A sheet S guided into the lower conveying passage by a switch guide 17 disposed at the branch point is discharged leftward from a first pair of discharge rollers 18, and is stocked on a sheet discharge tray 24 formed on the bottom surface of the in-body discharge space 22. On the other hand, a sheet S guided into the upper conveying passage by the switch guide 17 is discharged leftward from a second pair of discharge rollers 19, and is discharged onto an auxiliary discharge tray 25.

Figure 2:
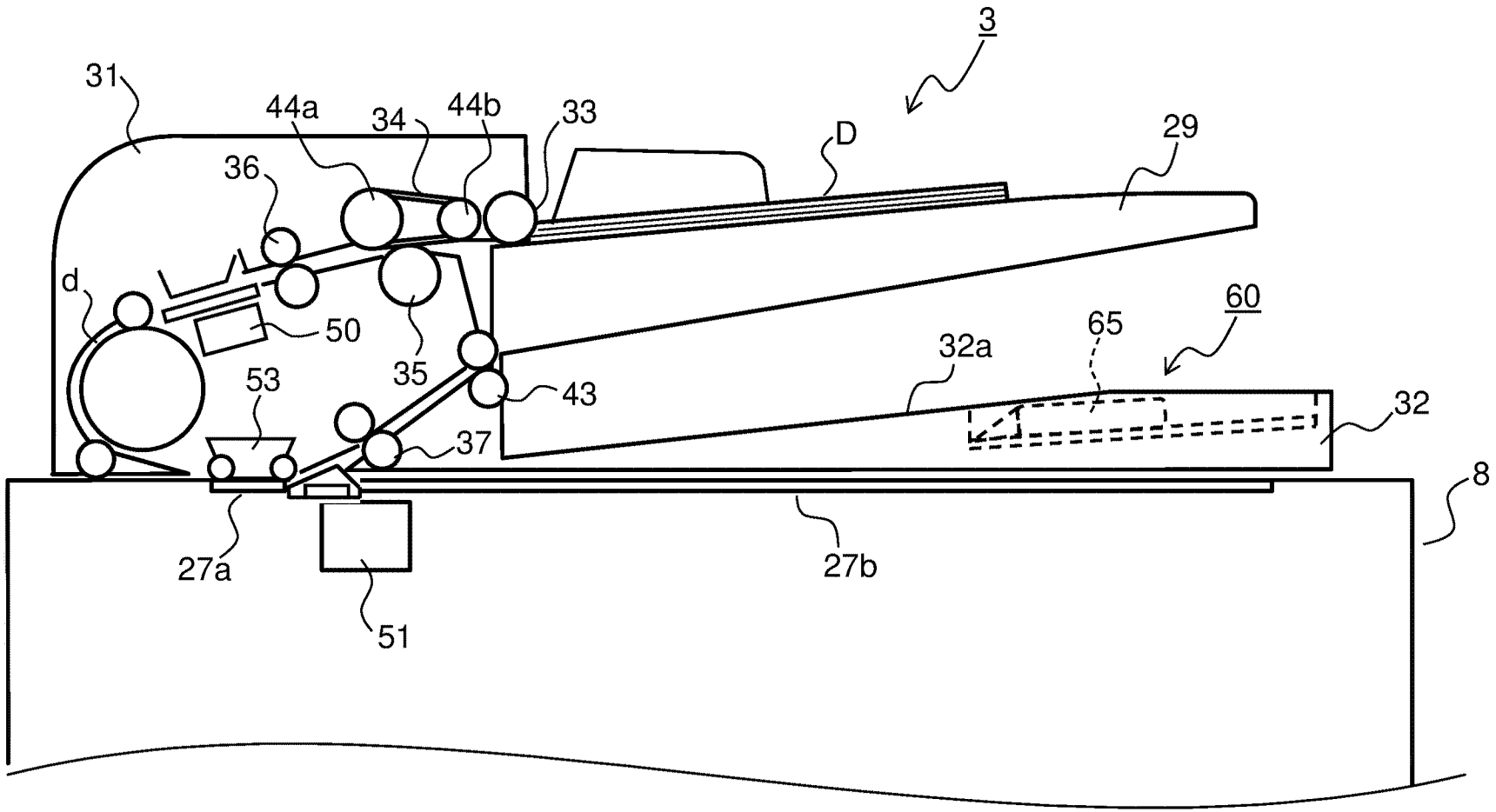
FIG. 2 is a sectional side view showing an internal structure of the document conveying device.

FIG. 2 is a sectional side view showing an internal structure of the document conveying device 3. On the top surface of the image reading portion 8, there is disposed a contact glass composed of an automatic reading glass 27*a* and a hand-placed document glass 27*b*. The document conveying device 3 is supported on a hinge portion (not shown) at the rear side (in FIG. 2, the far side with respect to the plane of FIG. 2) of the image reading portion 8 so as to be openable and closable up and down with respect to the image reading portion 8.

Inside a cover member 31 of the document conveying device 3, a document conveyance passage d is formed which leads from a document feed tray 29 to a document discharge tray (sheet stacking portion) 32. Along the document conveyance passage d, there are disposed: a document conveying member including a pickup roller 33, a sheet feed belt 34 and a separation roller 35, a pair of registration rollers 36, a pair of conveying rollers 37, and the like; a pair of discharge rollers (sheet discharge portion) 43 for discharging a document D; and a reverse-side reading module 50 for reading an image on a reverse side of the document D.

The document conveyance passage d is so curved as to turn around while leading from the pair of registration rollers 36 to the automatic reading glass 27*a*. The document conveyance passage d is, at appropriate positions, fitted with a plurality of sheet detection sensors (not shown), including a sheet feed sensor and a discharge sensor, for sensing the presence or absence of a document D or the passage of the document D.

Inside the image reading portion 8, an obverse-side reading module 51 is disposed. The obverse-side reading module 51 reads an image on a document placed on the hand-placed document glass 27*b* while moving in the sub scanning direction (in FIG. 2, the left-right direction). The obverse-side reading module 51 also reads an image on the obverse side of a document D conveyed by the document conveying device 3 while staying directly under the automatic reading glass 27*a*.

Next, sheet-through document conveying operation using the document conveying device 3 will be described. In sheet-through document conveying operation, a plurality of documents D are set image-side up on the document feed tray 29. Out of the documents D set on the document feed tray 29, typically a plurality of sheets at the top are fed, by the pickup roller 33, to a nip between the sheet feed belt 34 and the separation roller 35. Out of the plurality of documents D, the topmost one is separated by the separation roller 35, and is then conveyed over a predetermined distance toward the pair of registration rollers 36; then the pickup roller 33 and the sheet feed belt 34 stop being driven to rotate, and thus primary sheet feeding ends.

A predetermined period after the completion of primary sheet feeding, a secondary sheet feed drive motor (not shown) is actuated to drive the pair of registration rollers 36 to rotate. The document D is conveyed by the pair of registration rollers 36 toward the automatic reading glass 27*a*. The document D conveyed to the automatic reading glass 27*a* makes contact with a document pressing member 53 disposed opposite the automatic reading glass 27*a*, and is thereby pressed from above against the automatic reading glass 27*a*. Then an image on the obverse side (automatic reading glass 27*a*-side) of the document D is read by the obverse-side reading module 51 through the automatic reading glass 27*a*.

The document D having passed across the automatic reading glass 27*a* is conveyed toward the pair of conveying rollers 37 and the pair of discharge rollers 43, and is eventually discharged by the pair of discharge rollers 43 onto the document discharge tray 32.

When a double-sided document is read, an image on the reverse side of the document D is read by the reverse-side reading module 50 disposed upstream of the automatic reading glass 27*a*, and then an image on the obverse side of the document D is read by the obverse-side reading module 51.

On the document discharge tray 32, there is disposed a stopper 60 against which the leading end of the document D discharged by the pair of discharge rollers 43 is thrust to be aligned.

Figure 3:
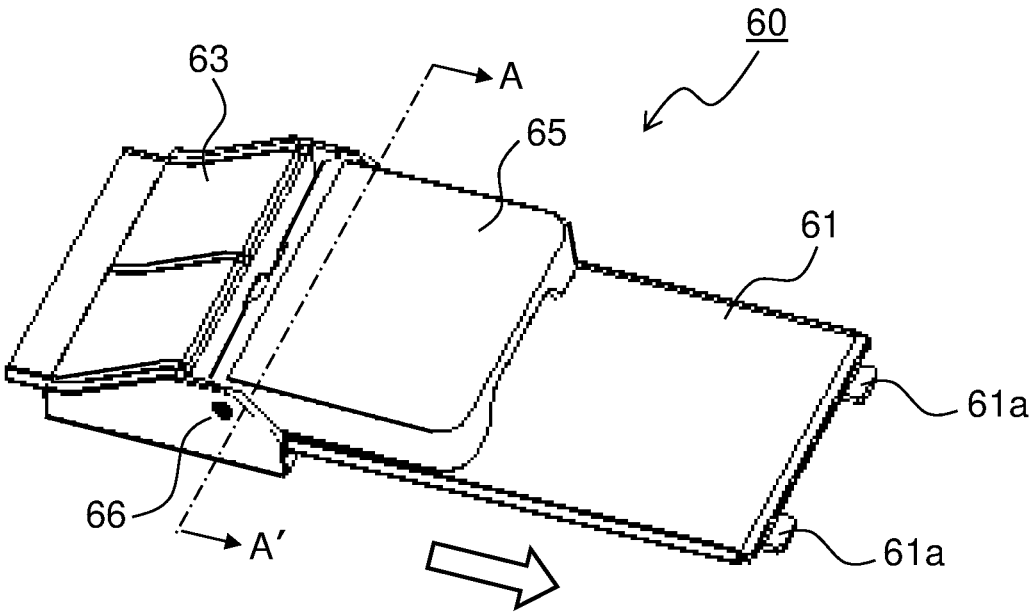
FIG. 3 is a perspective view of a stopper in a state where a restricting portion is arranged in a retracted position.
Figure 4:
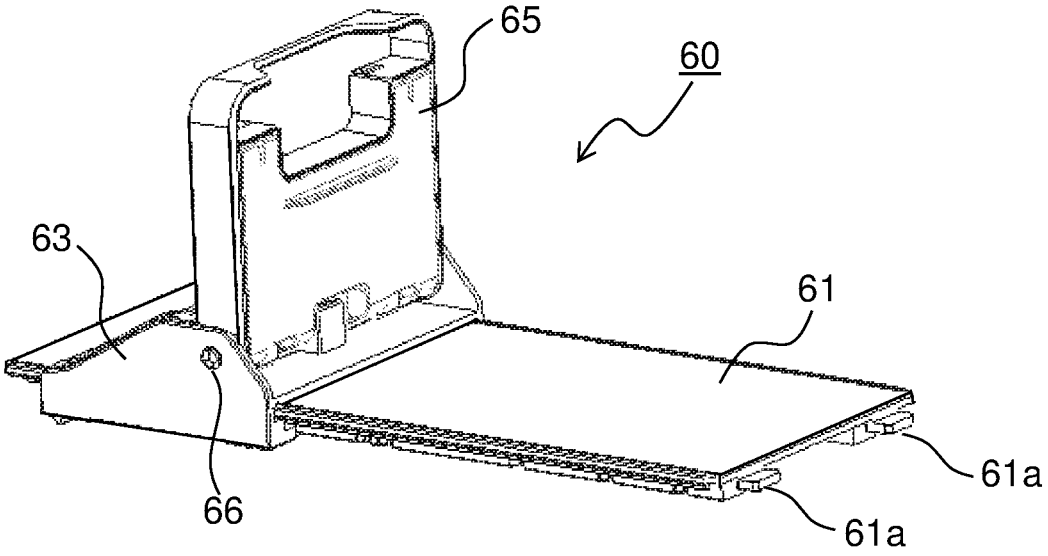
FIG. 4 is a perspective view of the stopper in a state where the restricting portion is arranged in a restricting position.
Figure 5:
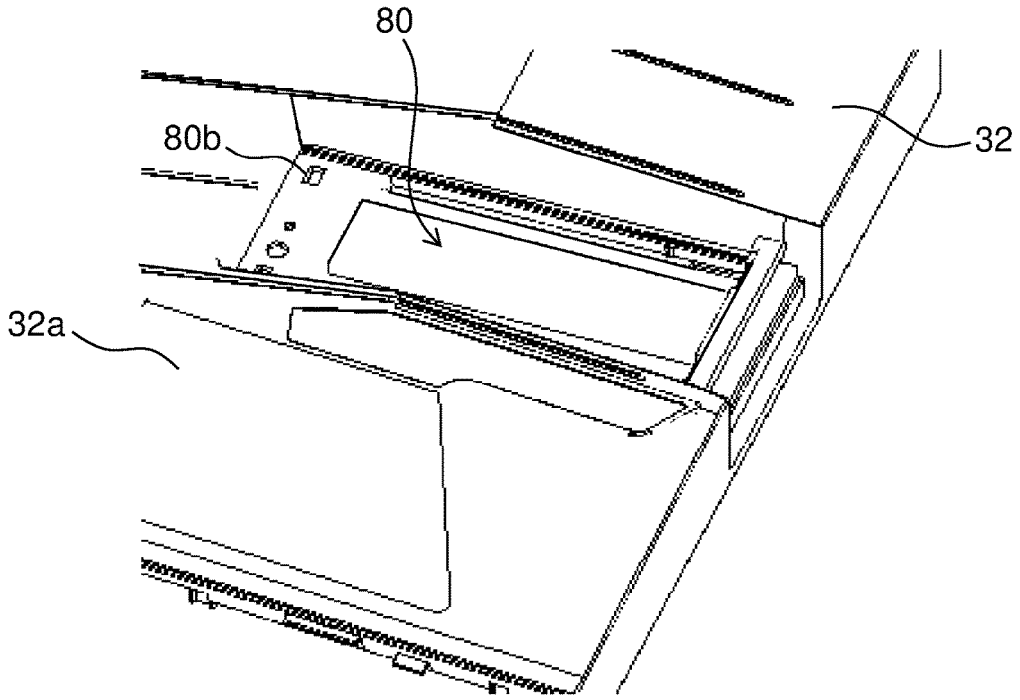
FIG. 5 is a perspective part view around a stopper fitting portion in a document stacking surface on a document discharge tray.

FIGS. 3 and 4 are perspective views of the stopper 60. FIG. 5 is a perspective part view around a stopper fitting portion 80 in a document stacking surface 32*a* on the document discharge tray 32. The stopper 60 has a base portion 61, a support portion 63, and a restricting portion 65.

The base portion 61 is in the shape of a rectangular plate, and is removably fitted in the stopper fitting portion 80, with a recessed shape, that is formed in the document stacking surface (sheet stacking surface) 32*a* on the document discharge tray 32 shown in FIG. 5. In one end part of the base portion 61, engagement claws 61*a* are formed. In another end part of the base portion 61, at two places on its bottom side, engagement hooks 61*b* (see FIG. 6) are formed.

When the stopper 60 is fitted in the stopper fitting portion 80, the engagement claws 61*a* of the base portion 61 are engaged with engaged portions 80*a* (see FIG. 11) formed in a downstream end part of the stopper fitting portion 80 with respect to the document discharge direction. At the same time, the engagement hooks 61*b* of the base portion 61 are engaged with engagement holes 80*b* formed in an upstream end part of the stopper fitting portion 80 with respect to the document discharge direction. In this state, the stopper 60 is fastened to the stopper fitting portion 80 with screws from the bottom side of the document discharge tray 32.

The support portion 63 is fitted on the top surface of the base portion 61 so as to be movable back and forth along the document discharge direction (in FIG. 3, the direction of the hollow arrow). The restricting portion 65 is supported pivotally on a pivot shaft 66 on the support portion 63. The restricting portion 65 is arranged selectively in one of a retracted position (see FIG. 3) in which the restricting portion 65 lies flat along the top surface of the base portion 61 and a restricting position (see FIG. 4) in which the restricting portion 65 stands upright substantially vertically with respect to the base portion 61. As shown in FIG. 2, when arranged in the retracted position, the restricting portion 65 is accommodated below the document stacking surface 32*a*.

Figure 6:
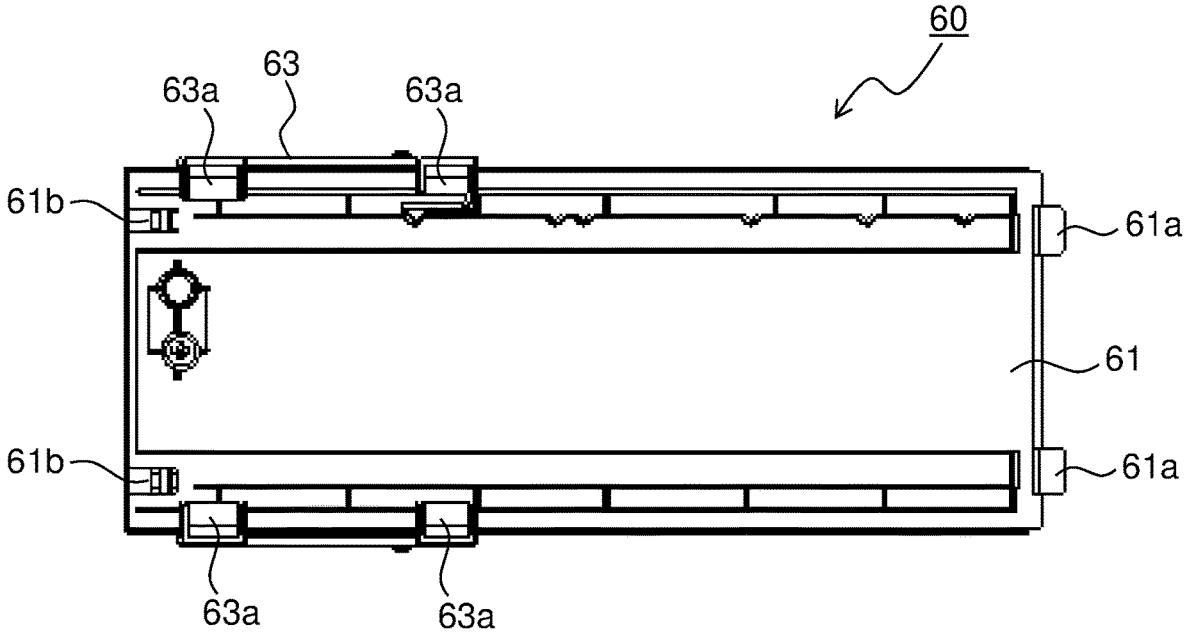
FIG. 6 is a plan view of the stopper as seen from its bottom side.
Figure 7:
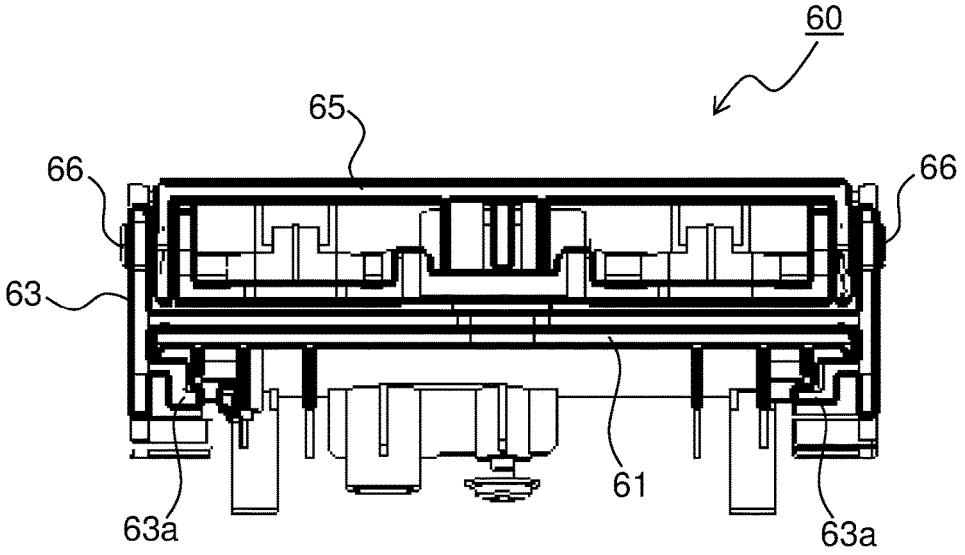
FIG. 7 is a sectional view of the stopper as cut along a direction perpendicular to the discharge direction.
Figure 8:
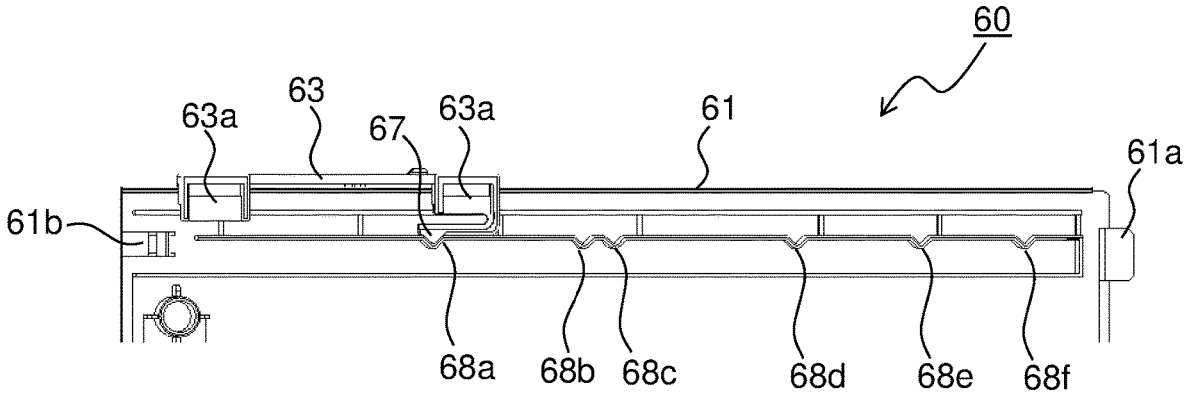
FIG. 8 is an enlarged part view of one side part of a base portion in FIG. 6 in its width direction.

FIG. 6 is a plan view of the stopper 60 as seen from its bottom side. FIG. 7 is a sectional view of the stopper 60 as cut in a direction perpendicular to the discharge direction (a sectional view as seen from the direction indicated by arrows AA' in FIG. 3). FIG. 8 is an enlarged part view of one side part (in FIG. 6, upper side part) of the base portion 61 in FIG. 6 in its width direction.

As shown in FIGS. 6 and 7, the support portion 63 has hook portions 63*a* that engage with, so as to embrace from opposite sides, opposite edges of the base portion 61 in its width direction (in FIG. 6, up-down direction) perpendicular to the document discharge direction. The hook portions 63*a* are provided at a total of four places, namely at two places at each side of the support portion 63 in its width direction. The hook portions 63*a* and the edges of the base portion 61 in its width direction engage so that the support portion 63 is supported so as to be movable back and forth across the base portion 61 along the document discharge direction.

As shown in FIG. 8, of the hook portions 63*a* at four places, one hook portion 63*a* (at the upper right in FIG. 6) has an engagement projection 67 formed on it. The engagement projection 67 is formed integrally with the hook portion 63*a*, and can deform elastically in a direction approaching or receding from the base portion 61 (in FIG. 8, the up-down direction).

In the base portion 61, engagement recesses 68*a* to 68*f* are formed at places that the engagement projection 67 faces as the support portion 63 is moved back and forth. The engagement recesses 68*a* to 68*f* are formed to correspond respectively to different sizes (regular sizes) of documents discharged onto the document discharge tray 32.

Figure 9:
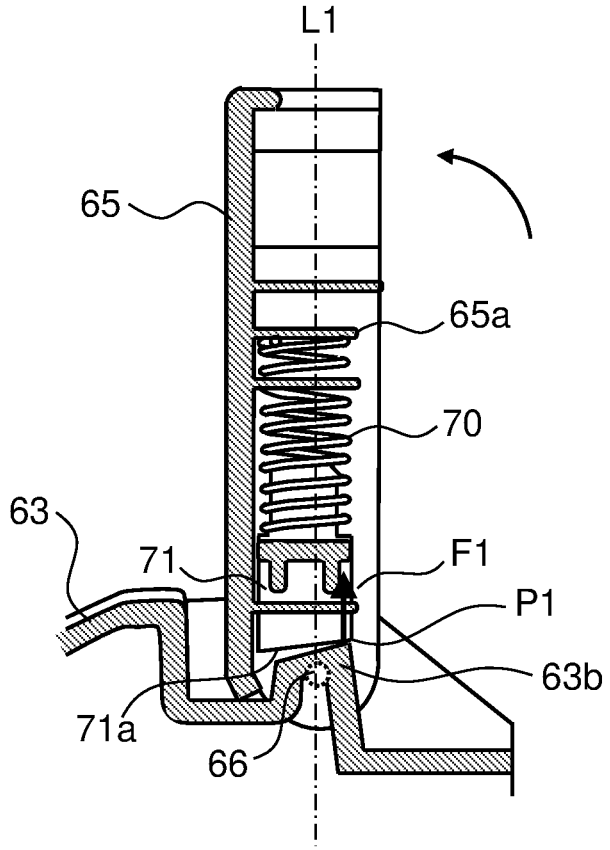
FIG. 9 is a sectional side view of the restricting portion arranged in the restricting position.
Figure 10:
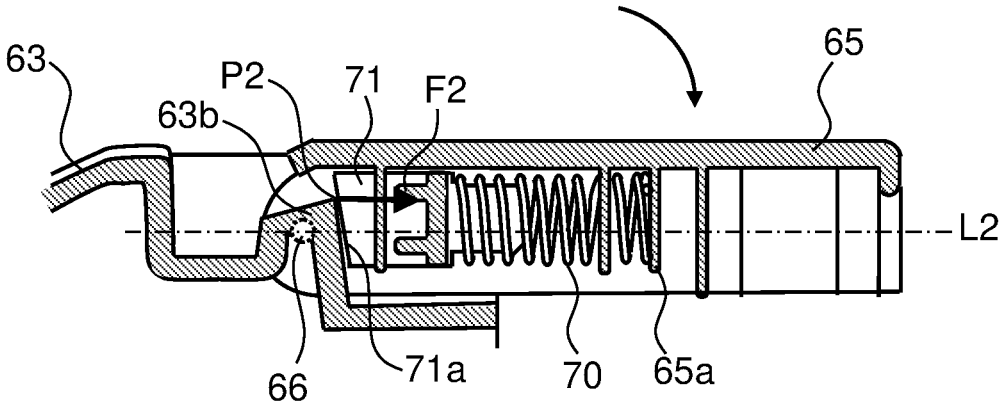
FIG. 10 is a sectional side view of the restricting portion arranged in the retracted position.

FIGS. 9 and 10 are side sectional views of the restricting portion 65, showing the restricting portion 65 arranged in the restricting position and in the retracted position respectively. Inside the restricting portion 65, a coil spring 70 is disposed. The coil spring 70 extends in the direction perpendicular to the pivot shaft 66, and one end part (at the far side with respect to the pivot shaft 66; in FIG. 9, an upper end part) of the coil spring 70 is fastened to a spring seat 65*a*. Another end part (at the closer side with respect to the pivot shaft 66; in FIG. 9, a lower end part) of the coil spring 70 is a free end, and is fitted with a pressing member 71. The pressing member 71 is urged by the urging force of the coil spring 70 in a direction approaching the pivot shaft 66. On the support portion 63, a pressed portion 63*b* is formed against which the pressing member 71 is pressed. The coil spring 70, the pressing member 71, and the pressed portion 63*b* constitute an urging mechanism that applies a pivoting load to the restricting portion 65.

As shown in FIG. 9, a pressing surface 71*a* of the pressing member 71 is inclined as seen from the axial direction of the pivot shaft 66. More specifically, with the restricting portion 65 arranged in the restricting position, the pressing surface 71*a* is inclined upward in the direction of movement toward the retracted position (in FIG. 9, rightward direction). The top surface of the pressed portion 63*b* of the support portion 63 has a steeper inclination than the pressing surface 71*a* with respect to the horizontal plane, and the pressed portion 63*b* and the pressing surface 71*a* make point contact with each other at a contact point P1. The contact point P1 is located, with respect to the direction of movement of the restricting portion 65 from the restricting position to the retracted position, downstream of (in FIG. 9, at the right side of) the vertical line L1 passing through the pivot shaft 66.

Thus the drag F1 that acts from the pressed portion 63*b* to the pressing surface 71*a* at the contact point P1 produces a counter-clockwise moment about the pivot shaft 66, and thereby urges the restricting portion 65 in the direction toward the restricting position (in FIG. 9, counter-clockwise). This prevents the restricting portion 65 arranged in the restricting position from easily moving to the retracted position. It is thus possible to suppress the inconvenience of the restricting portion 65 moving to the retracted position in response to, for example, an impact that may be imparted when a document discharged on the document discharge tray 32 is removed.

On the other hand, with the restricting portion 65 arranged in the retracted position, as shown in FIG. 10, the side surface of the pressed portion 63*b* of the support portion 63 has a steeper inclination than the pressing surface 71*a* with respect to the horizontal plane, and the pressed portion 63*b* and the pressing surface 71*a* make point contact with each other at a contact point P2. The contact point P2 is located, with respect to the direction of movement of the restricting portion 65 from the restricting position to the retracted position, upstream of (in FIG. 10, at the upper side of) the horizontal line L2 passing through the pivot shaft 66.

Thus the drag F2 that acts from the pressed portion 63*b* to the pressing surface 71*a* at the contact point P2 produces a clockwise moment about the pivot shaft 66, and thereby urges the restricting portion 65 in a direction toward the retracted position (in FIG. 10, clockwise). This prevents the restricting portion 65 arranged in the retracted position from easily moving to the restricting position. It is thus possible to suppress the inconvenience of the restricting portion 65 arranged in the retracted position moving to the restricting position when the document conveying device 3 is opened and closed with respect to the image reading portion 8 for the reading of a hand-placed document.

Figure 11:
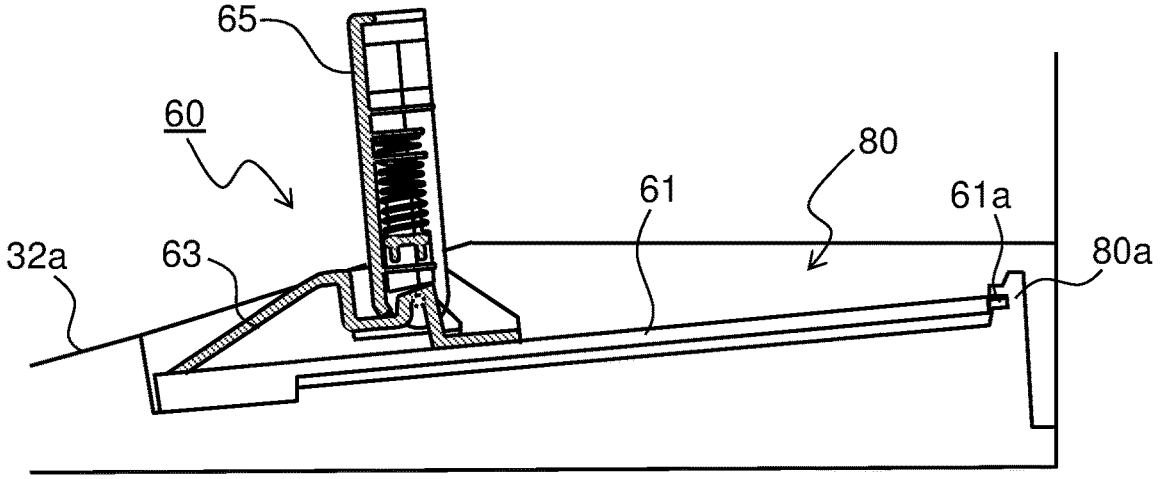
FIG. 11 is a sectional side view showing arrangement of the stopper for discharge of a small-size document.
Figure 12:
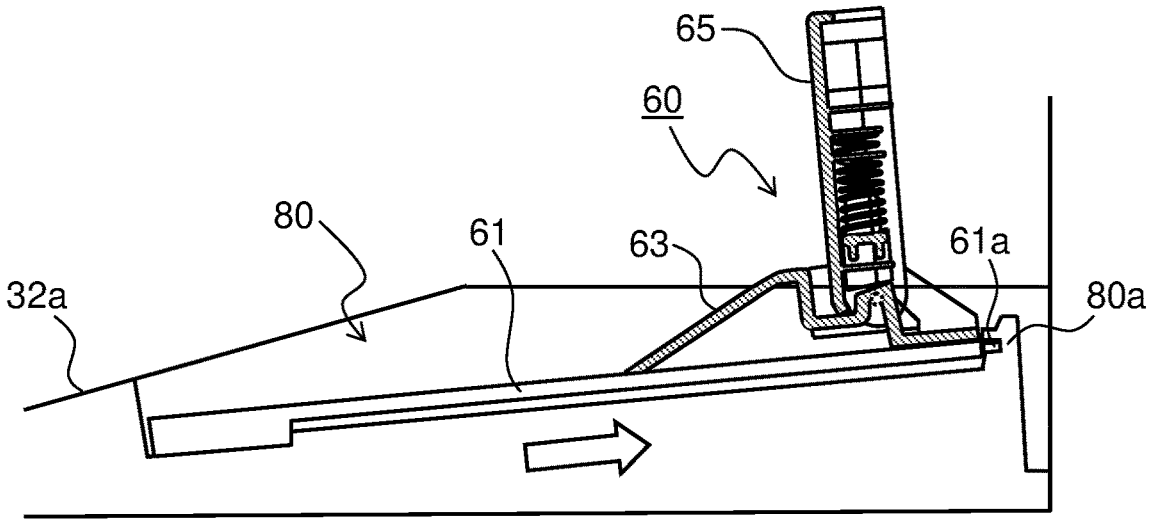
FIG. 12 is a sectional side view showing arrangement of the stopper for discharge of a large-size document.

FIGS. 11 and 12 are sectional side views showing the arrangement of the stopper 60 for the discharge of a small-size and a large-size document respectively. When the stopper 60 is used during the discharge of a document, the pivotal end of the restricting portion 65 is held and raised from the retracted position in which the restricting portion 65 lies flat along the document stacking surface 32*a* to the restricting position in which the restricting portion 65 stands upright substantially vertically with respect to the document stacking surface 32*a*. Next, the position of the restricting portion 65 is adjusted to suit the size (for example, A4 size or A5 size) of the document to be discharged onto the document discharge tray 32. Specifically, the support portion 63 is moved back and forth along the document discharge direction so that a size indicator mark (not shown) on the support portion 63 lies at a desired size indication (not shown) impressed on the document stacking surface 32*a*.

When the support portion 63 is arranged at the position corresponding to the desired document size, the engagement projection 67 (see FIG. 8) engages with one of the engagement recesses 68*a* to 68*f* (see FIG. 8) formed in the base portion 61. At this time, the feel of a click (feel of operation) that the engagement projection 67 produces when engaging with one of the engagement recesses 68*a* to 68*f* permits easy recognition of the support portion 63 and the restricting portion 65 now being at the position corresponding to the desired document size.

In the construction according to the embodiment, when the restricting portion 65 of the stopper 60 is arranged in the restricting position, the restricting portion 65 is urged by the coil spring 70 in the direction toward the restricting position; when the restricting portion 65 is arranged in the retracted position, the restricting portion 65 is urged by the coil spring 70 in the direction toward the retracted position. It is thus possible to prevent the restricting portion 65 from moving unexpectedly in response to vibration or impact, and thereby to enhance the operability and usability of the stopper 60.

Moreover, the support portion 63, which supports the restricting portion 65, is slidable with respect to the base portion 61; thus simply moving the support portion 63 back and forth permits the restricting portion 65 to be arranged at the position corresponding to the document size. This eliminates the need to change the fitting position of the stopper 60 or to prepare a separate stopper 60 for small sizes. Furthermore, the engagement projection 67 provided on the support portion 63 engages with one of the engagement recesses 68*a* to 68*f*, and thereby allows easy recognition of the support portion 63 and the restricting portion 65 being properly positioned.

The present disclosure is not limited by the embodiment described above and allows for various modifications without departure from the spirit of the present disclosure. For example, while the above embodiment deals with, as an example, a document conveying device 3 that incorporates a sheet discharge device including a pair of discharge rollers 43 for discharging a document and a document discharge tray 32 for stacking the discharged document as well as document conveying members such as a pickup roller 33, a sheet feed belt 34 and a separation roller 35, a pair of registration rollers 36, a pair of conveying rollers 37, and the like, the present disclosure applies equally to a sheet discharge device that includes a first pair of discharge rollers 18 incorporated in an image forming apparatus 100 and a sheet discharge tray 24 for staking a document discharged from the first pair of discharge rollers 18, or to a sheet discharge device incorporated in a sheet post-processing device for performing post-processing such as punching, stapling, or sorting on a document having an image formed on it.

The present disclosure finds applications in sheet discharge devices that include a sheet stacking portion for stacking a discharged sheet and a stopper against which the leading end of the sheet discharged onto the sheet stacking portion is thrust to be aligned. Based on the present disclosure, it is possible to provide a sheet discharge device in which unnecessary pivoting of a stopper can be restricted with a simple construction, and to provide an image forming apparatus that incorporates such a sheet discharge device.

What is claimed is:

1. A sheet discharge device, comprising:

a sheet discharge portion which discharges a sheet;

a sheet stacking portion disposed downstream of the sheet discharge portion with respect to a sheet discharge direction, the sheet stacking portion having a sheet stacking surface on which the sheet discharged from the sheet discharge portion is stacked; and a stopper provided in the sheet stacking portion, a leading end of the sheet discharged from the sheet discharge portion being thrust against the stopper to be aligned, wherein the stopper has:

a support portion;

a restricting portion supported pivotally on a pivot shaft provided on the support portion, the restricting portion being arranged selectively in one of a retracted position in which the restricting portion lies flat substantially horizontally along the sheet stacking surface and a restricting position in which the restricting portion stands upright substantially vertically with respect to the sheet stacking surface; and an urging mechanism which applies a pivoting load to the restricting portion, and the urging mechanism urges the restricting portion, when arranged in the retracted position, in a direction from the restricting position to the retracted position and urges the restricting portion, when arranged in the restricting position, in a direction from the retracted position to the restricting position.

2. The sheet discharge device according to claim 1, wherein the urging mechanism includes:

a coil spring disposed to be perpendicular to the pivot shaft, one end part of the coil spring farther from the pivot shaft being fastened to inside the restricting portion, another end part of the coil spring closer to the pivot shaft being a free end;

a pressing member fastened to the another end part of the coil spring, the pressing member being urged in a direction approaching the pivot shaft; and a pressed portion disposed on the support portion, the pressing member being pressed against the pressed portion, with the restricting portion arranged in the restricting position, a drag that acts from the pressed portion to the pressing member produces a moment in a direction from the retracted position to the restricting position about the pivot shaft, and with the restricting portion arranged in the retracted position, the drag that acts from the pressed portion to the pressing member produces a moment in a direction from the restricting position to the retracted position about the pivot shaft.

3. The sheet discharge device according to claim 2, wherein the pressing member has a pressing surface that, with the restricting portion arranged in the restricting position, is inclined upward in a direction of movement to the retracted position, the pressed portion and the pressing surface being in point contact with each other, with the restricting portion arranged in the restricting position, a contact point between the pressing member and the pressed portion is located, with respect to a direction of movement of the restricting portion from the restricting position to the retracted position, downstream of a vertical line passing through the pivot shaft, and with the restricting portion arranged in the retracted position, the contact point between the pressing member and the pressed portion is located, with respect to the direction of movement of the restricting portion from the restricting position to the retracted position, upstream of a horizontal line passing through the pivot shaft.

4. The sheet discharge device according to claim 1, wherein when arranged in the retracted position, the restricting portion is accommodated below the sheet stacking surface.

5. The sheet discharge device according to claim 1, wherein the stopper has a base portion that is fitted in a stopper fitting portion formed in the sheet stacking surface, and the support portion is supported so as to be movable back and forth along the sheet discharge direction across the base portion.

6. The sheet discharge device according to claim 5, wherein the support portion has a plurality of hooks that engage with, so as to embrace from opposite sides, opposite edges of the base portion in a width direction thereof perpendicular to the sheet discharge direction, at least one of the hooks has an engagement projection that can deform elastically in a direction approaching or receding from the base portion, and on the base portion, at places that the engagement projection faces, a plurality of engagement recesses are formed so as to correspond to different sizes of the sheet discharged on the sheet stacking surface.

7. A document conveying device, comprising:

the sheet discharge device according to claim 1; and a document conveying member which conveys a sheet-form document to the sheet discharge device.

8. An image forming apparatus, comprising:

an image forming portion which forms an image on a sheet-form recording medium; and the sheet discharge device according to claim 1 which discharges the recording medium having the image formed by the image forming portion.

* * * * *